US006726576B1

(12) United States Patent
Froggatte

(10) Patent No.: US 6,726,576 B1
(45) Date of Patent: Apr. 27, 2004

(54) GOLF STANCE FOOT ALIGNMENT, BALL POSITION AND CLUB FACE SQUARE GUIDE

(76) Inventor: Samuel D. Froggatte, 1380 Woodmoor Dr., Monument, CO (US) 80132

( * ) Notice: Subject to any disclaimer, the term of this patent is extended or adjusted under 35 U.S.C. 154(b) by 0 days.

(21) Appl. No.: 10/128,968

(22) Filed: Apr. 24, 2002

(51) Int. Cl.[7] ..... A63B 69/36
(52) U.S. Cl. ..... 473/270; 473/272
(58) Field of Search ..... 473/270, 266, 473/268, 271, 272, 273, 279, 218; 403/59, 83, 84, 87

(56) References Cited

U.S. PATENT DOCUMENTS

| | | | | | |
|---|---|---|---|---|---|
| 1,517,555 | A | * | 12/1924 | Graham | 33/508 |
| 1,922,130 | A | * | 8/1933 | Haserodt | 33/508 |
| 2,150,580 | A | * | 3/1939 | Crowley | 473/273 |
| 2,169,407 | A | * | 8/1939 | Crowley | 473/272 |
| 3,638,950 | A | * | 2/1972 | Hyotlaine | 473/271 |
| 3,658,344 | A | * | 4/1972 | Kimble | 473/272 |
| 3,868,116 | A | * | 2/1975 | Ford et al. | 473/218 |
| 4,257,608 | A | * | 3/1981 | Funk | 473/272 |
| 4,354,683 | A | * | 10/1982 | Woolland | 473/218 |
| 4,538,815 | A | * | 9/1985 | Poirier | 473/218 |
| 4,563,010 | A | * | 1/1986 | McDorman et al. | 473/267 |
| 4,583,739 | A | * | 4/1986 | Kabbany | 473/218 |
| 4,784,393 | A | * | 11/1988 | Williams et al. | 473/272 |
| 5,180,168 | A | * | 1/1993 | Balestrieri | 473/218 |
| 5,203,453 | A | * | 4/1993 | Dirito | 206/315.3 |
| 5,246,234 | A | * | 9/1993 | Zambelli | 473/272 |
| 5,322,288 | A | * | 6/1994 | Amis | 473/272 |
| 5,335,915 | A | * | 8/1994 | Baudier | 473/218 |
| 5,362,060 | A | * | 11/1994 | Hinson | 473/218 |
| 5,388,833 | A | * | 2/1995 | Goyen, Jr. | 473/218 |
| 5,415,407 | A | * | 5/1995 | Beatty | 473/409 |
| 5,435,727 | A | * | 7/1995 | Dobson | 434/252 |
| 5,464,220 | A | * | 11/1995 | Hansen et al. | 473/218 |
| 5,527,037 | A | * | 6/1996 | Matsumoto | 473/218 |
| 5,616,085 | A | * | 4/1997 | LaCoste et al. | 473/267 |
| 5,827,125 | A | * | 10/1998 | Lee | 473/139 |
| 5,951,409 | A | * | 9/1999 | Calley | 473/218 |
| 6,077,168 | A | * | 6/2000 | Huang | 473/218 |
| 6,440,004 | B1 | * | 8/2002 | Rodriguez | 473/218 |

* cited by examiner

*Primary Examiner*—Gregory Vidovich
*Assistant Examiner*—Nini F. Legesse
(74) *Attorney, Agent, or Firm*—Frank J. Catalano

(57) ABSTRACT

A guide assists a golfer to assume a proper golf swing stance. A coupling joins first and second elongated members with their axes in perpendicular relationship. The second member overlies the first. The coupling is slidably disposed on the first member and the second member is slidably disposed on the coupling. The first member provides a visual aid for the alignment of the golfer's feet parallel to an imaginary target line and the second member provides a visual aid positioning the ball in the stance and for squaring the face of the club to the ball at the point of impact.

6 Claims, 6 Drawing Sheets

Fig. 3
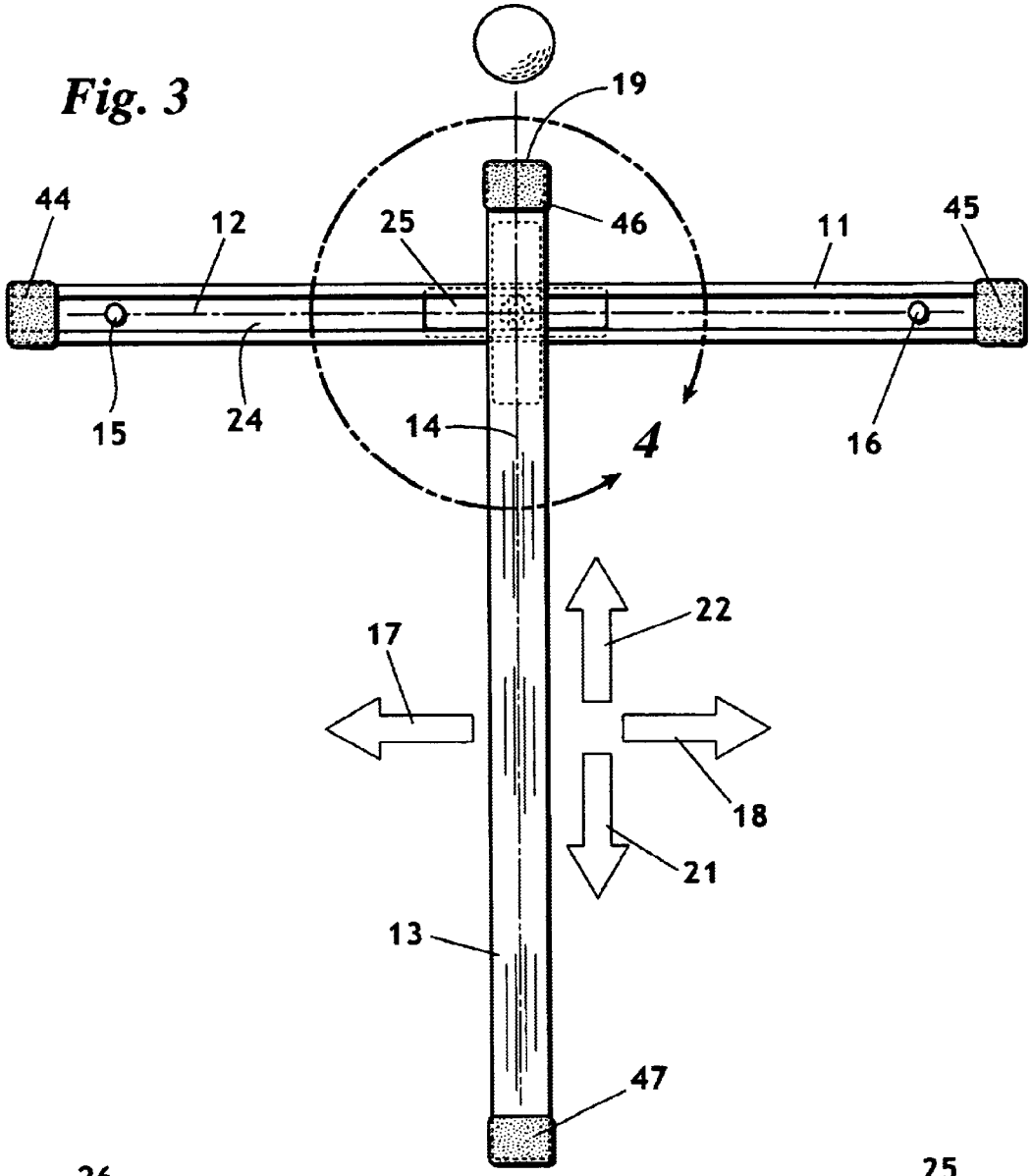
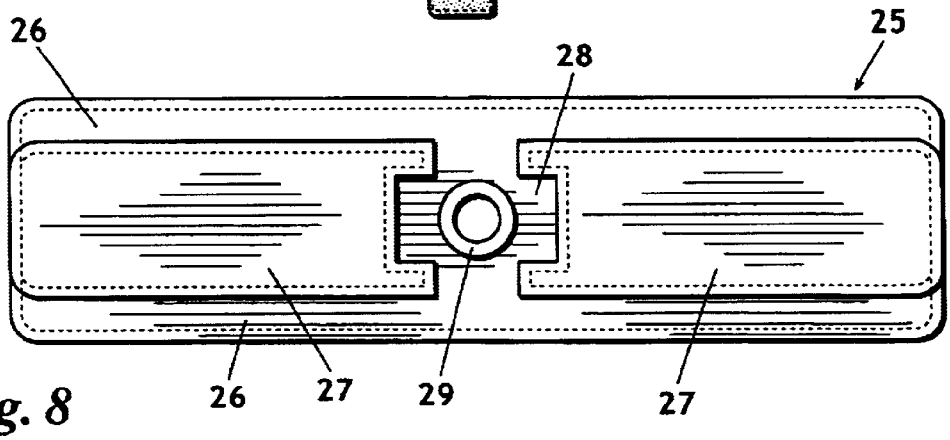
Fig. 8

GOLF STANCE FOOT ALIGNMENT, BALL POSITION AND CLUB FACE SQUARE GUIDE

BACKGROUND OF THE INVENTION

This invention relates generally to golf more particularly concerns a training tool to assist in correctly aligning the golfer's feet with the target line of a golf shot, in correctly positioning the ball between the golfer's feet and in correctly squaring the club face to the ball at the point of impact.

Ideally, in addressing a golf ball, the golfer should be positioned with the toes of both feet on a line parallel to an imaginary target line for the shot. The stance should also position the ball so that a line intersecting the ball and perpendicular to the target line passes slightly inside of the forwardmost heel of the golfer. Finally, the club face should be "square" to the ball, that is perpendicular to the target line at the point of impact of the club face with the ball. A stance as above described results in the feet, hips and shoulders being aligned parallel to the target line at address, the ball being positioned properly in the stance and a square club face at the moment of impact, all of which maximizes the likelihood of an accurately hit golf shot.

When a practice shot wanders from its intended mark, golfers will often lay the shaft of the club they used for the shot across their toes while holding their finish position and then step back and observe the alignment of the club. Frequently, the club shaft is aligned with the actual flight line of the shot rather than the intended target line, indicating that the error was the result of improper alignment of the feet at address. This procedure is of no use in actually achieving proper foot alignment, ball positioning or club face squaring. It is merely a post shot spot check method for identifying one possible cause of inaccuracy.

It is not uncommon for a golfer who is working on the practice tee to improve accuracy to lay a club on the ground on a line parallel to the target line as a guide for foot alignment before taking a practice shot. While this procedure does assist in proper foot alignment, it does not help in proper ball positioning or club face squaring. Furthermore, since it does not properly position the ball or square the club face, the procedure affords only incomplete data as to the real causes of any inaccuracy in the completed shot. The above described procedure of using a golf club for an alignment check is convenient, because the tool is already in the golf bag. No single tool exists which facilitates correct foot alignment, ball positioning and club face squaring, much less one which is simple to use, easy to carry and fits in the golf bag.

It is also a problem in a practice sessions, especially practice with irons, that each practice shot is likely to result in a divot being taken. Consequently, each successive ball must be placed in a different place on the practice area. A nonsystematic placement of the balls causes the divots to be randomly dispersed on the practice area, making it increasingly more difficult to find a proper lie as the practice session continues. This reduces the effective use of the total practice area and increases maintenance problems for the groundskeeper.

It is, therefore, an object of this invention to provide a guide which facilitates achievement of accuracy in golf shots. Another object of this invention is to provide a guide which assists in correctly aligning a golfer's feet in relation to an imaginary target line. A further object of this invention is to provide a guide which assists in correctly positioning a golf ball in the stance of the golfer. Yet another object of this invention is to provide a guide which assists in correctly squaring of the club face with the ball at the point of impact. It is also an object of this invention to provide a guide which can be secured to the ground once for use in a single practice session consisting of many shots. Still another object of this invention is to provide a guide which can be adjusted without being released from the ground to index a new ball position for each shot in a practice session. An additional object of this invention is to provide a guide which can be adjusted both longitudinally and transversely to permit each of many practice shots to be taken from a different ball location. Another object of this invention is to provide a guide which indexes sequential practice shot ball locations in a relatively tight matrix. A further object of this invention is to provide a guide which is easily stored and carried in a golf bag. Yet another object of this invention is to provide golf stance guide which can be secured to the ground by use of fasteners normally found in a golf bag, such as golf tees.

SUMMARY OF THE INVENTION

In accordance with the invention, a guide is provided for assisting a golfer to assume a proper golf swing stance. A first elongated member has a first longitudinal axis. A second elongated member has a second longitudinal axis. The second member overlies the first member. A coupling joins the members with their axes in perpendicular relationship. The coupling is slidably disposed on the first member and the second member is slidably disposed on the coupling. Consequently, a ball positioning end of the second member can be incrementally displaced in relation to the first axis and the second axis can be incrementally displaced along the first member. Thus, the ball positioning end of the second member can be shifted to index a matrix of ball locating positions.

In a preferred embodiment, the members have C-shaped cross-sections defining longitudinal slots therein with the slots opposed face-to-face. The coupling has a first component slidably engaged in the cross-section of the first member and a second component slidably engaged in the cross-section of the second member. These components are joined for rotation in relation to each other between a first condition in which the axes of the elongated members are in parallel relationship for storage of the guide and a second condition in which the axes of the elongated members are in perpendicular relationship for practice with the guide. In the second condition, the ball positioning end of the second member is incrementally displacable from the first axis and the second axis is incrementally displacable along the first member to permit shifting of the ball positioning end of the second member to index a ball location matrix. Preferably, the components are rotatively joined on a pivot pin integrally extending from one of the components into an aperture in the other component. A cross-shaped plug on one of said components is matable with cross-shaped socket on the other to lock the components in either the first or second condition. The plug and socket are biased, as by a coil spring, toward a mating relationship. The first member is adapted to be secured to the ground, such as by provision of at least two spaced apart apertures through the web of the first member, for insertion of golf tees therein. Four caps cover each end of the members to prevent the coupling components from sliding out of their respective members.

In use, the first member provides a visual aid for the alignment of the golfer's feet parallel to an imaginary target line and the second member provides a visual aid positioning the ball in the stance and for squaring the face of the club to the ball at the point of impact. The ball positioning end of the first member provides a visual aid for incrementally shifting to index a matrix of ball locations for many sequential practice shots without detaching the guide from the ground. After each shot, a tap of the ball positioning end of the second member with the heel of the practice club shifts the ball position end slightly forward the golfer for placement of the next ball. When one row of the matrix is filled by divots, the second member is tapped slightly toward the rear foot of the golfer and the ball position end of the second member extended away from the golfer to start a new row of the matrix. A soft cap may be used to cover the ball positioning end of the second member so as to protect the heel of the club in the tapping action.

BRIEF DESCRIPTION OF THE DRAWINGS

Other objects and advantages of the invention will become apparent upon reading the following detailed description and upon reference to the drawings in which:

FIG. 3 is a top plan view of the guide of FIG. 1 illustrated in relation to a golf ball;

FIG. 8 is a top plan view of the foot aligning component of the coupling of FIG. 5;

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION

Figure 1:
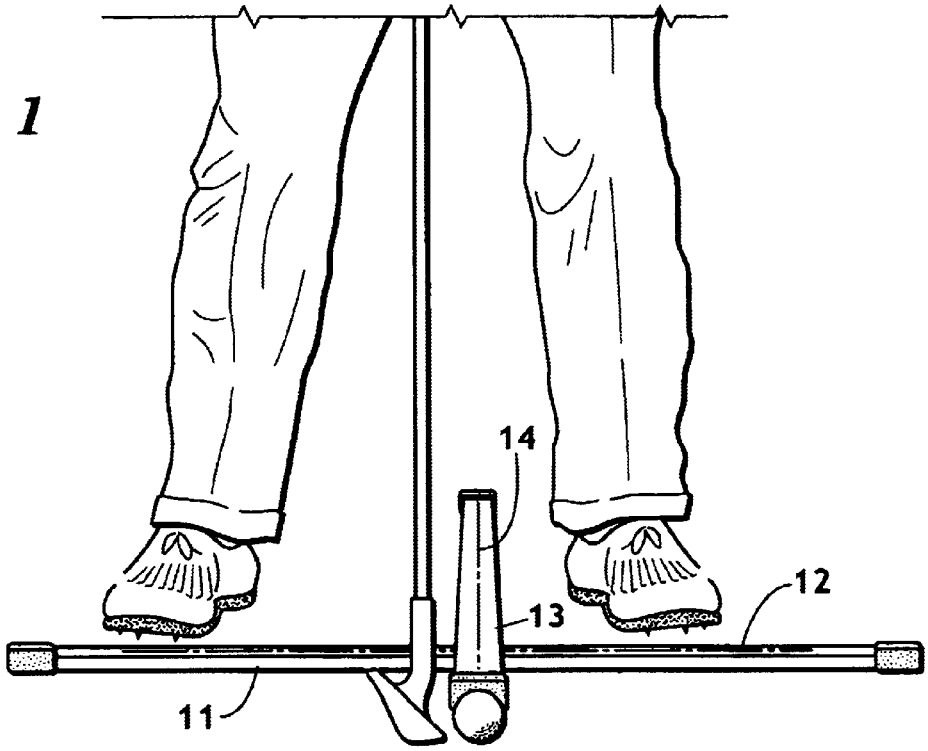
FIG. 1 is a transverse-to-target-line perspective view of a preferred embodiment of the guide illustrated in relation to a golfer's feet, ball and club face.
Figure 2:
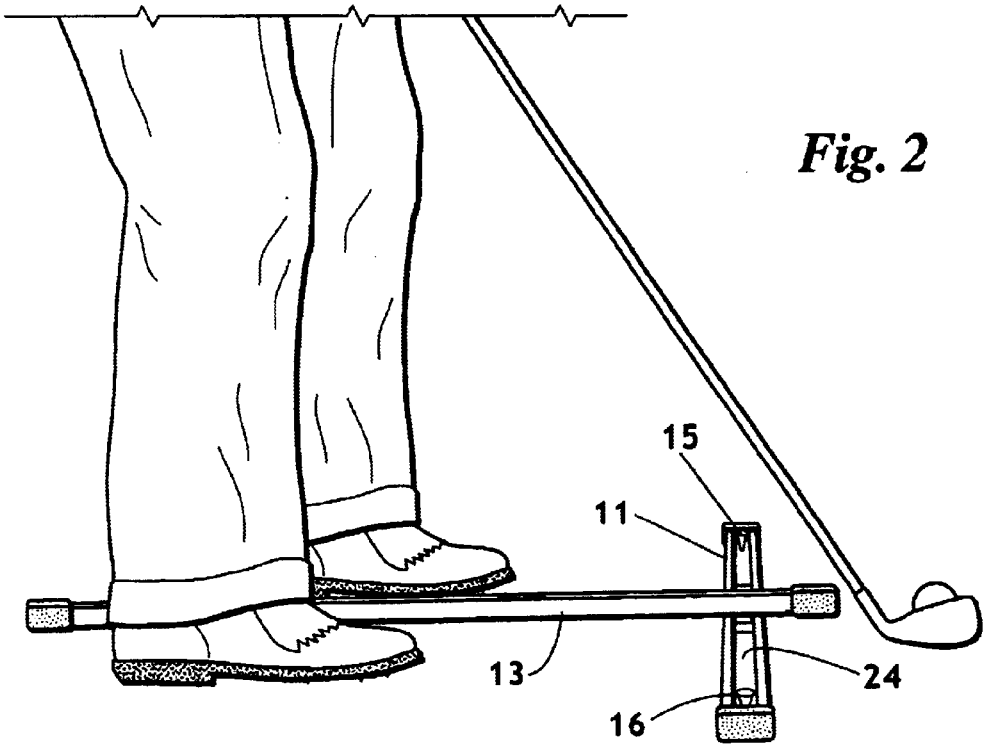
FIG. 2 is a target line perspective view of the guide of FIG. 1 illustrated relative to a golfer's feet, ball and club face.
Figure 7:
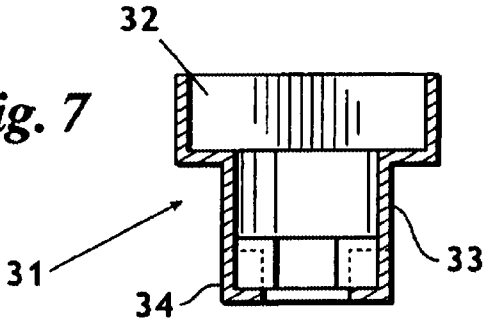
FIG. 7 is a cross sectional view taken along the line 7—7 of FIG. 6.
Figure 9:
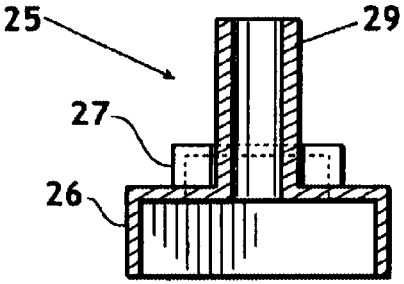
FIG. 9 is a cross-sectional view taken along the line 9—9 of FIG. 8.

Turning first to FIG. 1, a preferred embodiment of the guide is illustrated with a golfer's feet and club positioned in a typical address stance to a golf ball. It is from this position that the golf swing is executed. FIGS. 1 and 2 assume that the golfer has correctly placed the first member 11 on the ground with its longitudinal axis 12 parallel to an imaginary target line extending from the ball to a distant target selected by the golfer. If this is correctly achieved, the golfer need only align the toes of both feet on a line parallel to the first member 11 to be assured that the feet are properly aligned for an accurate golf shot. The second or ball aligning member 13 lies over the first member 11 with its longitudinal axis 14 perpendicular or transverse to the longitudinal axis 12 of the first member. As seen, the second member 13 extends between the inside of the golfer's forward heel and the midpoint between the golfer's heels. This ball position is typical for producing an accurate golf shot. Thus, the second member allows the golfer to properly position the golf ball in the golf stance. Finally, the golfer can align the face of the golf club with the axis 14 of the second member 13 so that, at the point of impact with the ball, the club face is square to the imaginary target line or parallel to the second member 13. A square club face typically produces an accurate golf shot. Thus, with proper use of the guide, the golfer can be assured of proper foot alignment, ball position and club face squaring so as to maximize the possibility of an accurate shot.

The above description is given in relation to ideal or orthogonal foot alignment, ball position and face squaring criteria. However, some golfers prefer, for various reasons, to use either an open or a closed stance in which the forward foot is spaced differently from the first member than the rear foot, or to position the ball more forwardly or rearwardly in the stance or to close or open the club face in relation to square. While such choices complicate the visual application of the guide, the guide still provides a fixed reference according to which all of these criteria may be adjusted.

Figure 4:
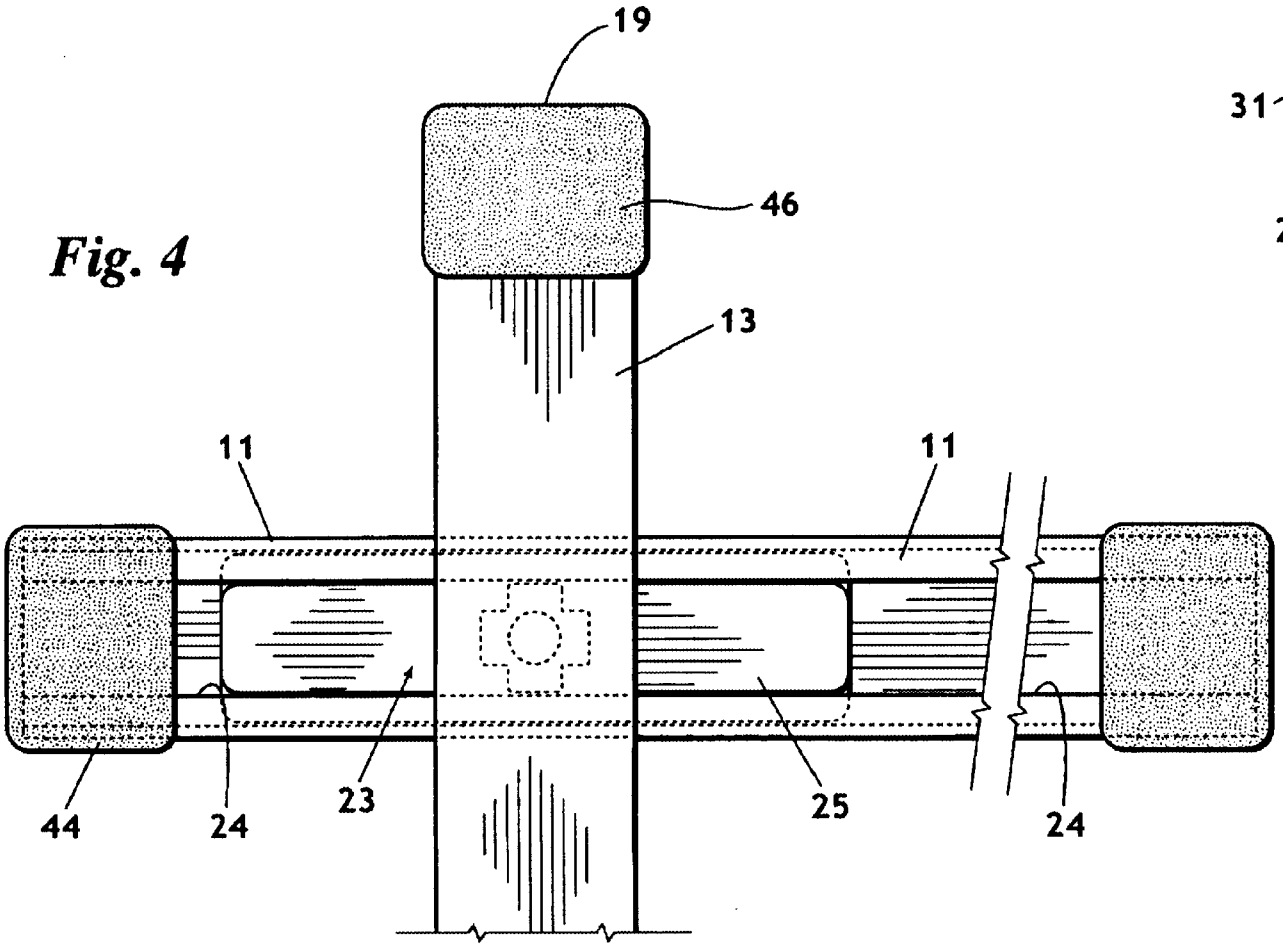
FIG. 4 is an exploded top plan view of portions of the ball positioning and aligning members of the guide of FIG. 1.

As best seen in FIG. 2, the first member 11 is secured in place on the ground by use of a pair of golf tees 15 and 16 inserted through small apertures (not shown) provided in the member 11. In the execution of a golf shot, the sole of the club will often remove a divot from the ground forward of the golf ball and generally parallel to the first member 11. On each successive practice shot, the golfer will choose a new lie of the ball so as to not be playing the ball where a divot has been taken. Therefore, as shown in FIG. 3, it is desirable to move or reposition the second member 14 toward and away from the target as illustrated by arrows 17 and 18, respectively, or to move the ball positioning end 19 of the second member 14 toward or away from the golfer as shown by arrows 21 and 22, respectively. To accomplish this, as is best seen in FIG. 4, the members 11 and 13 are joined by a coupling 23 which maintains the members 11 and 13 at right angles to each other. The coupling 23 has one component which is slidably engaged on the first member and a second component on which the second member 13 is slidably engaged. Thus, the ball positioning end 19 of the second member 13 can be shifted to index a matrix of positions by incrementally shifting the ball positioning end 19 in the direction of the inward and outward arrows 21 and 22 and by incrementally shifting the position of the coupling 23 in the first member 11 in the direction of the forward and rearward arrows 17 and 18.

Figure 5:
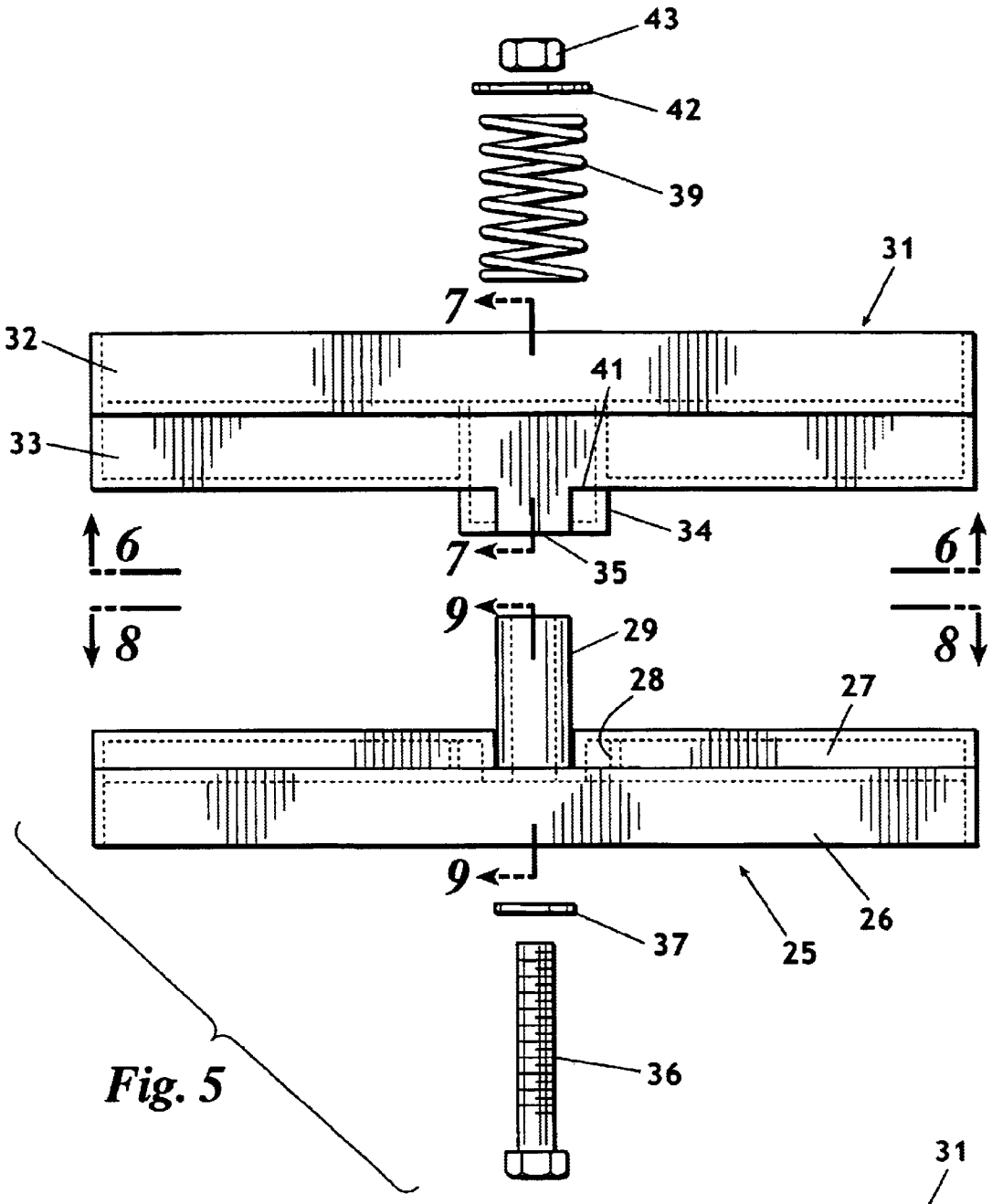
FIG. 5 is a front elevation assembly view of a preferred embodiment of a coupling for joining the ball positioning and foot aligning members of the guide of FIG. 1.
Figure 6:
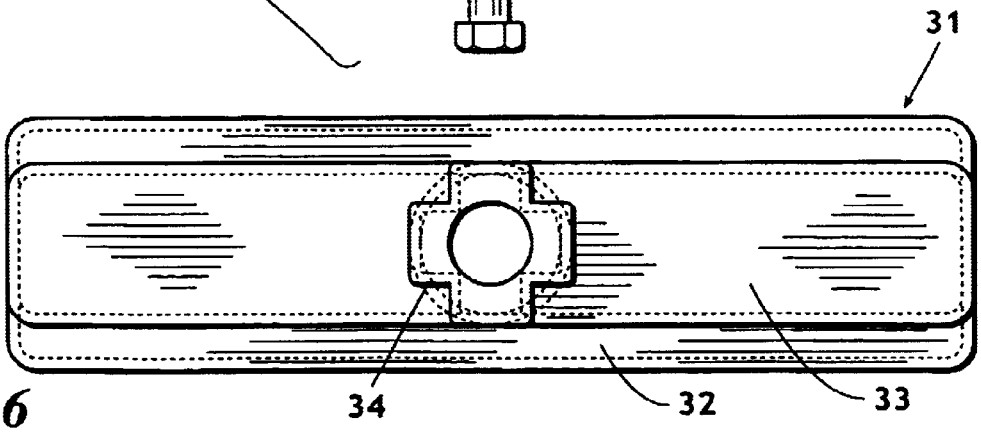
FIG. 6 is a bottom plan view of the ball positioning component of the coupling of FIG. 5.
Figure 10:
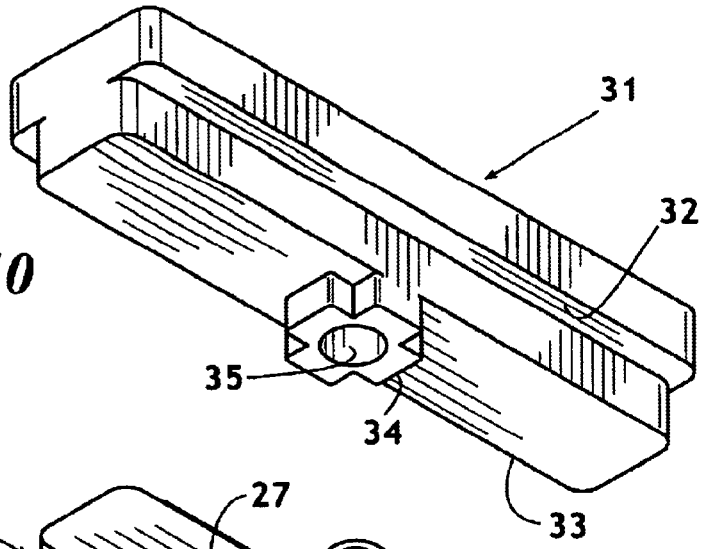
FIG. 10 is a bottom perspective view of the ball positioning component of the coupling of FIG. 5.
Figure 11:
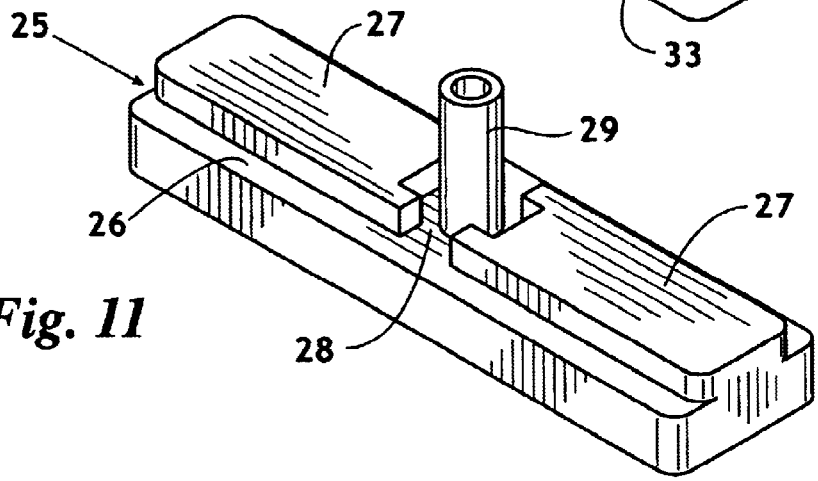
FIG. 11 is a top perspective view of the foot aligning component of the coupling of FIG. 5.
Figure 12:
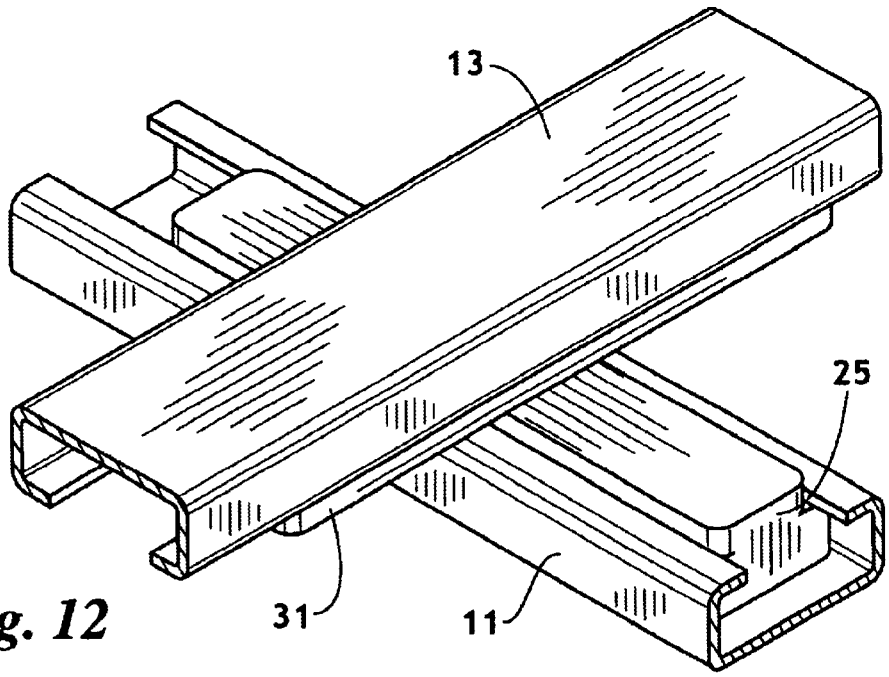
FIG. 12 is a top perspective view of the coupling of FIG. 5 in a perpendicular condition.
Figure 13:
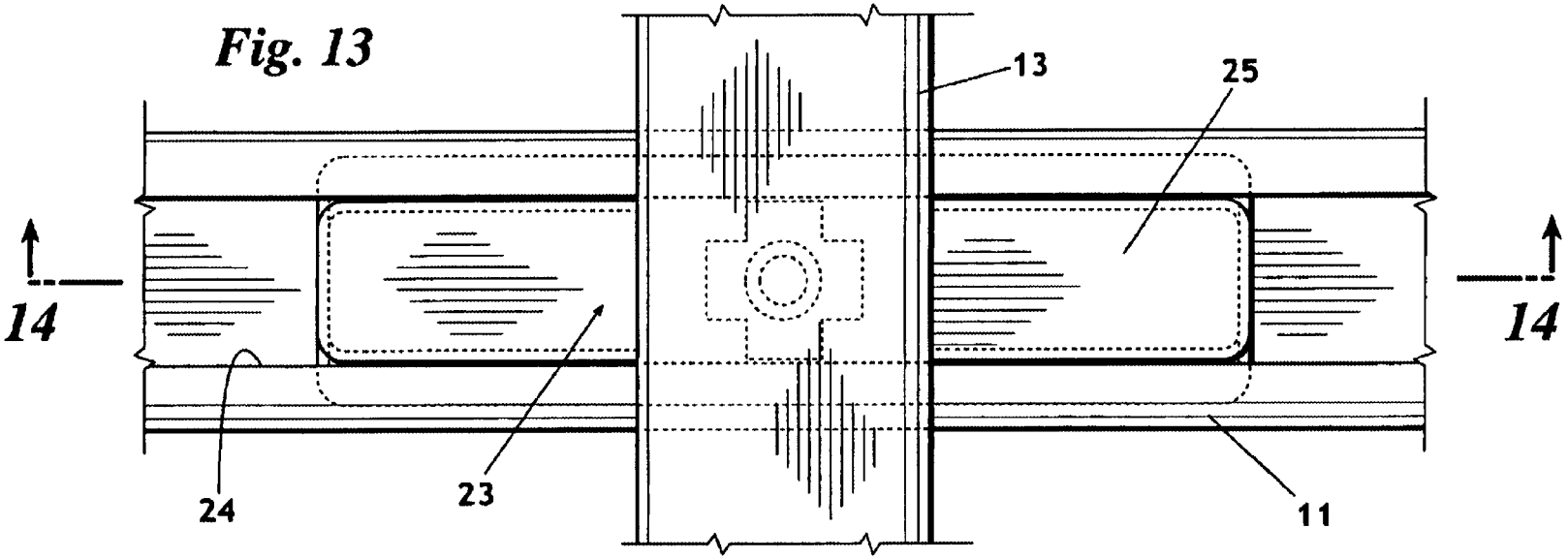
FIG. 13 is a top plan view of the coupling of FIG. 5 in a perpendicular condition.
Figure 14:
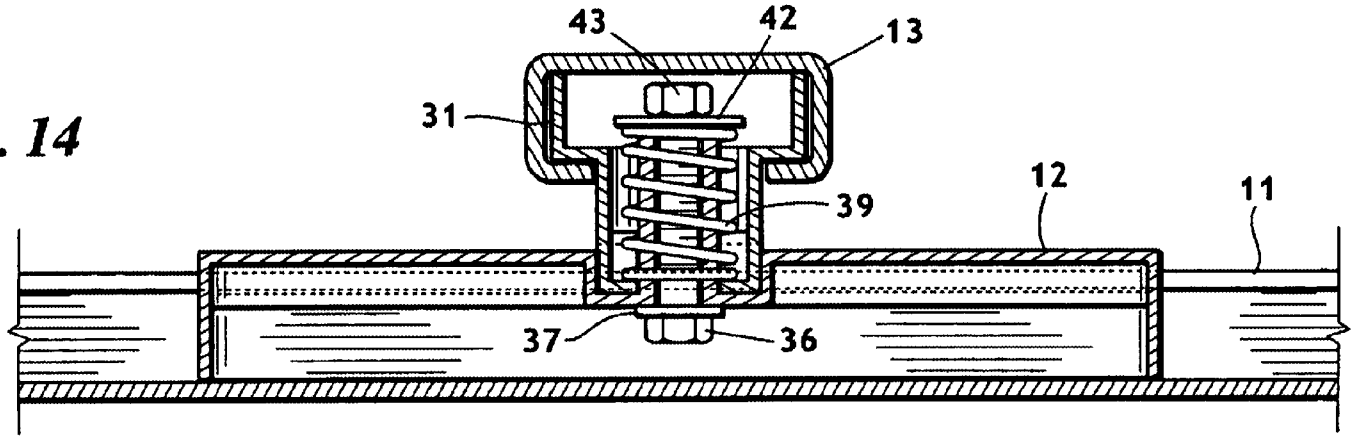
FIG. 14 is a cross-sectional view taken along the line 14—14 of FIG. 13.

In the preferred embodiment, as seen in FIGS. 2 and 4, the first member 11 has a C-shaped cross-section with a slot 24 extending along the length of the member 11 and the second member 13 is identical to the first member 11 in cross-section. However, the slot (not shown) of the second member 13 is in opposed face-to-face relationship with the slot 24 of the first member 11. Turning to FIGS. 5 through 14, the preferred embodiment of the coupling for connecting the C-shaped cross-section members 11 and 13 is illustrated. As shown, the first or bottom component 25 of the coupling 23 has a base 26 of rectangular cross-section which slides in the first member 11. A top portion 27 of the bottom component 25 extends upwardly through the slot 24 in the first member 11. The cross-sectional contour of the base 26 and top portion 27 of the bottom component 25 complements the contour of the cross-section of the interior of the first member 11 and the slot 24 so as to maintain the sliding bottom component 25 in alignment within the member 11. As best seen in FIG. 8, the top portion 27 the bottom component 25 is divided by a cross-shaped socket 28. A tubular spindle 29 extends upwardly from the top of the base 26 and is centered on the socket 28. As the bottom component 25 slides in the first member 11, the spindle 29 slides in the slot 24. The second or top component 31 of the coupling 23 has an inverted configuration relative to the first component 25. The base 32 is of rectangular cross section and slides in the second member 13. The bottom portion 33 of the top component 31 extends downwardly through the slot (not shown) in the second member 13. The cross sectional contour of the base 32 and bottom portion 33 of the top component 31 complements the contour of the cross section of the interior of the second member 13 and its slot (not shown) so as to maintain the sliding top component 31 in alignment within the member 13. As best seen in FIG. 6, the bottom portion 33 of the top component 13 has a cross-shaped plug 34 which will seat firmly in the cross-shaped socket 28 when the top portion 27 of the bottom component 25 and the bottom portion 33 of the top component 31 are in abutment. When the socket 28 and plug 34 are mated, the coupling components 25 and 31 are locked against rotational motion relative to each other. The top component 31 also has an aperture 35 into which the spindle 29 is inserted so that the top component 31 is rotatable about the spindle 29 on the bottom component 25. The coupling 23 is held together by a bolt 36 extending through a washer 37 and through the tubular spindle 29. The bolt 36 extends upwardly through the aperture 35 in the top component 31. A compression spring 39 inserted through the base 32 of the top component 31 is concentrically seated around the spindle 29 of the bottom component 31 against the inside wall 41 of the bottom portion 33 of the top member 31. A washer 42 and nut 43 engage on the threaded end of the bolt 36 to compress the spring 39 and bias the lower 25 and upper 31 components of the coupling 23 toward each other. With the lower 25 and upper 31 components of the coupling 23 aligned as shown in FIG. 5, the spring 39 holds the plug 34 in the socket 28 to lock the components 25 and 31 in parallel alignment. By pulling the components 25 and 31 apart against the bias of the spring 39, the plug 34 and socket 28 are disengaged so that the components 25 and 31 are free to rotate with respect to each other on the spindle 29 until the components 25 and 31 are in perpendicular relationship to each other. In this position, if the components 25 and 31 are released to bias, the bias of the spring 39 pulls the plug 34 into the socket 28 to lock the components 25 and 31 in the perpendicular arrangement. Thus, the coupling 23 may be used to secure the components 25 and 31 in a first position in which they are parallel for storage of the guide and a second position in which they are perpendicular for use of the guide in practice.

The guide is assembled by inserting one of the coupling components 25 or 31 into the end of one of the members 11 or 13 and inserting the other of the components 25 or 31 into the other of the members 11 or 13. With the coupling 23 joining the members 11 and 13, end caps 44, 45, 46 and 47 are placed over the ends of the members 11 and 13 to assure that the coupling 23 cannot slide out of either member 11 or 13. The end caps also serve the purpose of protecting other equipment with which the ends of the members 11 and 13 may come into contact. For storage, the coupling 23 is operated as above described to align the axes 12 and 14 of the members 11 and 13 and the members 11 and 13 are permitted to slide on the coupling 23 to collapse the guide into its smallest configuration. In a prototype device, the members 11 and 13 are made of three foot long sections of 1" wide by 7/16" deep struts of steel or aluminum, the coupling 23 is made of molded plastic and the end caps 44, 45, 46 and 47 are made of soft plastic.

For use in a practice session, the golfer rotates the coupling 23 so that the members 11 and 13 are perpendicular to each other. As earlier discussed in relation to FIGS. 1 and 2, the foot aligning member 11 is placed on the ground at the practice area in parallel relationship to an imaginary line from a golf ball to a distant target selected by the golfer. Golf tees 15 and 16 are inserted into the apertures in the foot aligning member 11 to secure the member 11 in place for the practice session. The ball positioning member 13 is positioned to intersect with the foot aligning member 11 at a forward portion of the foot aligning member 11. The ball positioning end 19 of the ball positioning member 13 is positioned away from the golfer by sliding the ball positioning member 13 on the coupling 23 until, with the golfer's feet relatively close to the foot aligning member 11, the ball positioning end 19 of the ball positioning member 13 is slightly inside of the club face at the impact point with the ball. A ball is placed on the ground a slight distance beyond the ball positioning end 19 of the member 13. Using the guide to correctly position the stance, the golfer rests the sole of the club at the impact point with the ball. The golfer then positions the feet with the toes on a line parallel to the first member 11 and with the second member 13 on a line extended slightly inside of the golfer's forward heel. The golfer also confirms that the face of the club is parallel to the axis 14 of the second member 13. The golfer is now positioned for an accurate golf shot. When the shot is completed, if a divot has been taken the golfer taps the ball positioning end 19 of the member 13 with the heel of the club to shift the ball positioning end 19 approximately the width of a divot. The next ball is placed and a practice shot completed and the process continued until the ball positioning member 13 has been shifted so that its ball positioning end 19 is in close proximity to the foot aligning member 11. The golfer then taps the ball positioning member 13 to shift it rearwardly on the foot aligning member 11 for approximately the length of a divot. The ball positioning end 19 of the ball positioning member 13 is then shifted to the outermost extremity as was used for the first practice shot. Another sequence of practice shots can be taken until a second row of divots is completed, at which time the ball positioning end 19 is shifted to a first column, third row index of the matrix, and so on. Thus, the ball positioning end 19 of the member 13 indexes rows and columns of practice ball positions enabling many practice shots to be taken in a relatively tightly matrixed area without removing the guide from the ground.

Plugs 34 and sockets 28 may have configurations other than the cross-shaped configurations illustrated. The coupling 23 can be inverted between the members 11 and 13. Biasing mechanisms other than the coil spring shown may be used. However, it is apparent that there has been provided, in accordance with the invention, a golf stance guide that fully satisfies the objects, aims and advantages set forth above. While the invention has been described in conjunction with a specific embodiment thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A guide for assisting a golfer to assume a proper golf swing stance comprising first and second elongated horizontal members and a coupling having top and bottom components pivotally connected for rotation about a vertical axis of said coupling, one of said components having a plug and another of said components having a socket matable with said plug for securing said components a perpendicular practice condition and in a parallel storage condition, said first elongated member being slidably disposed on one of said components and said second elongated member being slidably disposed on another of said components whereby said elongated members are slidably displacable in relation to each other to permit shifting of an end of one of said elongated members to index a matrix of positions.

2. A guide for assisting a golfer to assume a proper golf swing stance comprising a first elongated member having a first longitudinal axis, a second elongated member having a second longitudinal axis, said second member overlying said first member, and a coupling having a first component slidably engaged on said first member, a second component slidably engaged on said second member and means joining said components for rotation in relation to each other and means integral with said components for mating in a first condition for storage of the guide with said axes in parallel relationship and in a second condition with said axes in perpendicular relationship for practice with the guide wherein an end of said second member is incrementally displacable from said first axis and said second axis is incrementally displacable along said first member to permit shifting of said end of said second member to index a matrix of positions.

3. A guide for assisting a golfer to assume a proper golf swing stance comprising a first elongated member having a first longitudinal axis and a C-shaped cross-section defining a first longitudinal slot therein, a second elongated member having a second longitudinal axis and a C-shaped cross-section defining a second longitudinal slot therein, said second member overlying said first member with said slots opposed face-to-face, and a coupling having a first component slidably engaged in said first member, a second component slidably engaged in said second member, a pivot pin extending from one of said components into an aperture in another of said components joining said components for rotation in relation to each other and a cross-shaped plug on one of said components, a mating cross-shaped socket on another of said components and means biasing said plug and said socket toward a mating relationship for securing said components in a first condition for storage of the guide with said axes in parallel relationship and in a second condition with said axes in perpendicular relationship for practice with the guide with an end of said second member incrementally displacable from said first axis and said second axis incrementally displacable along said first member to permit shifting of said end of said second member to index a matrix of positions.

4. A guide according to claim 3, a web of said first member having at least two spaced apart apertures therethrough for insertion of golf tees therein.

5. A guide according to claim 3 further comprising four end caps, one on each end of said members.

6. A guide according to claim 5, said cap covering said ball positioning end of said second member being soft.

* * * * *